United States Patent [19]

Becker

[11] 3,937,005

[45] Feb. 10, 1976

[54] KEY FOR REMOVING LOCKING MEMBERS FROM DRIVE CHAINS OR THE LIKE

[76] Inventor: Raymond Becker, 3754 Ramsey Court, El Sobrante, Calif. 94803

[22] Filed: Feb. 18, 1975

[21] Appl. No.: 550,267

[52] U.S. Cl. ..... 59/7; 81/3 R; 29/225

[51] Int. Cl.[2] ..... B21I 21/00

[58] Field of Search ..... 81/3 R, 3.46 A; 29/253, 29/267, 225, 230; 59/7, 11

[56] References Cited

UNITED STATES PATENTS

| | | | |
|---|---|---|---|
| 2,571,401 | 10/1951 | Williams | 81/3.46 A |
| 2,577,193 | 12/1951 | Imse | 29/225 |
| 3,854,282 | 12/1974 | Mazel | 59/7 |

*Primary Examiner*—Al Lawrence Smith
*Assistant Examiner*—Roscoe V. Parker
*Attorney, Agent, or Firm*—Bruce & McCoy

[57] ABSTRACT

A key for removing locking members from drive chains or the like comprised of a rigid body, at least one release groove and one reset groove formed in said body, with said release groove being tapered to form a wedge with one end of said body and being adapted to engage with, lift, and then release said locking member from said drive chain when the key is suitably positioned within the central opening of a fastened locking member and rotated therein, and with said reset groove being formed such that, when the reset groove end of the key is suitably placed within the central opening of an unfastened locking member suitably positioned over the sprocket shafts of adjacent chain links, the key can be rotated to reset the locking member to a fastened position.

4 Claims, 8 Drawing Figures

KEY FOR REMOVING LOCKING MEMBERS FROM DRIVE CHAINS OR THE LIKE

BACKGROUND OF THE INVENTION

1. FIELD OF THE INVENTION

The present invention relates to small specialized tools, and more particularly to a key device which can remove locking members from drive chains or the like, and which can also replace an unfastened or detached locking member in locking engagement with the drive chain assembly.

2. DESCRIPTION OF THE PRIOR ART

Drive chains, that is, chains which transmit power from one rotating shaft to another, are widely used and have a variety of industrial and non-industrial applications. Most people recognize drive chains as being a continuous chain made up of rigid individual elements, or links, tied together in such a manner that adjacent elements can rotate with respect to one another about parallel axes and in a plane common to all of the elements. Thus, a chain is provided which is flexible in a common plane, but is substantially rigid with respect to any force component outside of that plane.

The links of a drive chain are joined together by link connectors, and by removing the link connectors the chain can be disassembled for repair or replacement of a damaged link. To provide this disassembly capability, releasable locking members in the form of elongated lock washers are used to hold the link connectors in a locked in position. To disconnect two adjacent chain links, the locking member must first be removed.

To applicant's knowledge, these locking members have heretofore been removed with a screwdriver by wedging the end of the screwdriver underneath the locking member, and prying it off of the chain links. This method has proven to be very awkward and time consuming since it is difficult to both hold the drive chain with one hand, and position the screwdriver with the other so as to wedge the screwdriver end underneath the locking member while obtaining suitable leverage to pry the locking member free. In fact, this procedure can often be very frustrating since it is a common experience to have the screwdriver painstakingly positioned such that the locking member is nearly released, only to have the screwdriver slip along the metal surfaces, and the locking member spring back into locking engagement in seeming defiance of any renewed attempts at prying it loose. To add to the frustration of these time consuming efforts, every time the screwdriver slips, any portion of the body which is close to the working area is in danger of receiving a cut or puncture wound.

The present invention overcomes the difficulties and hazards of using a screwdriver, or the links, to pry locking members off of the links of a drive chain by providing a key device which can easily and quickly remove a locking member by a simple twisting motion, and which with a similar twisting motion can also be used to easily and quickly replace the locking members back into its locked position. Using the present invention there is no danger of slipping and cutting one's hand, and also the present invention has the advantage of preventing excessive bending and twisting of the locking member by imparting just that amount of distortion to the locking member which will remove it from the chain link.

SUMMARY OF THE INVENTION

The present invention is a key for removing locking members from drive chains or the links. The key is comprised of a rigid body having an elongated portion with a flat end of a size to fit within the central opening of the chain locking member. At least one release groove is formed in the body, and this release groove is positioned adjacent to and parallel the flat end of said elongated portion. The groove is tapered to form a wedge with the flat end whereby, when the flat end of the elongated portion of the body is placed within the central opening of the locking member and the flat end is held against the underlying chain link, the key can be rotated to permit both the release groove to engage one of the internal edges within the central opening of the locking member, and the side of the body opposite the release groove to engage the opposite internal edge. As the key is further rotated, the wedge formed by the release groove causes the locking member to separate and lift from its locked position.

In addition to a release groove, a reset groove is provided such that, when the reset groove end of the key is placed within the central opening of a detached locking member which is suitably positioned, the key can be rotated to reset the locking member to its locked position on the drive chain.

OBJECTS OF THE INVENTION

It is therefore an important object of the present invention to provide a key device which can be used to quickly and easily remove lock washers from drive chains, or the like.

It is another object of the present invention to provide a key device for removing locking members from drive chains, or the like, which can safely be used without the possibility that it will slip off of the locking member and cut or puncture the hand of the operator.

It is a further object of the present invention to provide a key device which in addition to being used to remove locking members from a drive chain, can also be used to quickly and easily replace the locking member back into its locked position on the drive chain.

It is still another object of the present invention to provide a key device for removing locking members from drive chains, or the like, which by eliminating excessive bending or twisting of the locking member increases the useful life thereof.

It is still a further object of the present invention to provide a device for removing locking members from drive chains, or the like, which can easily be carried in a persons pocket such as on a key chain.

And it is yet another object of the present invention to provide a key for removing locking members from a drive chain which can be manufactured at a very small expense, and consequently, could sell at a very nominal price.

Other objects of the present invention will become apparent from the description of the preferred embodiment contained in the following specification and claims.

DESCRIPTION OF THE PREFERRED EMBODIMENT

Figure 1:
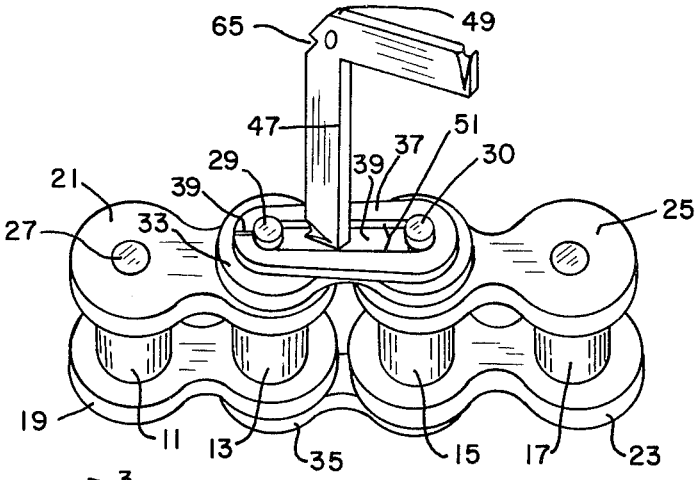
FIG. 1 is a perspective view of the key device of the present invention together with a section of a drive chain showing the present invention in its operative position for releasing the locking member from the drive chain.

The present invention is a key device for removing locking members, often times referred to as lock washers, from drive chains for the purpose of detaching one link of the drive chain from an adjacent link. The locking members of the drive chain keep the individual chain links locked together and work in the following manner: Referring to FIG. 1 of the drawings, each drive chain link is comprised of two load bearing steel cylinders 11, 13 and 15, 17 which are rotatably mounted on inner cylinders, not shown. Two side plates 19, 21 and 23, 25 are provided with each chain link, and each side plate has a hole such as 27 formed in each end thereof. The side plates are secured to the ends of the inner cylinders such that the holes in the ends of the side plates and the inner cylinder bores align to provide cylindrical passages through the entire chain link. Through these cylindrical passages are inserted sprocket shafts such as 29 and 30 which extend beyond the sides of the link, and about which the individual chain links can rotate.

Each link is held together by joining plates 33, 35 which, like the side plates of the chain links, also have holes formed in either end thereof. One sprocket shaft 29, 33 of each of two adjacent chain links are fitted through these holes thereby tying the two adjacent links together. On many drive chains, one joining link 35 will be held onto the respective sprocket shafts by having that end of the sprocket shafts flared; the opposite joining plate 33 on the other side of the chain is in turn held onto the ends of the sprocket shaft by means of locking member 37.

Locking member 37 is an elongated washer split through its entire width at 39 and held in place against joining plate 33 on the ends of the sprocket shafts 29, 30 which protrude through joining plate 33. These sprocket shaft ends have enlarged end portions, and the size of the locking member's central opening 39 is such that the locking member will closely fit around the shaft diameter within the enlarged ends, but not around the enlarged ends themselves. Hence, when snapped into position about sprocket shafts 29 and 30, and against joining plate 33, the locking member will prevent the joining plate from sliding off of the ends of the sprocket shafts; when removed, the links can be disconnected by first removing joining plate 33, and then removing the assembly of the sprocket shafts and joining plate 35 by sliding the sprocket shafts through the inner cylinders secured between side plates 19, 21, and 23, 25.

To remove the locking member from sprocket shafts 29 and 30, it is necessary to spread the legs of the locking member formed by the locking member's elongated sides until the width of the central opening 39 is sufficient to allow the locking member to fit over the enlarged ends of the sprocket shafts. The locking members are fabricated of metal and, in order to so effect their release, a considerable upward and outward force is required to overcome the restoring forces involved. Likewise, when the locking member is to be reset to locking engagement with the sprocket shafts a considerable downward and outward force is required.

Figure 2:
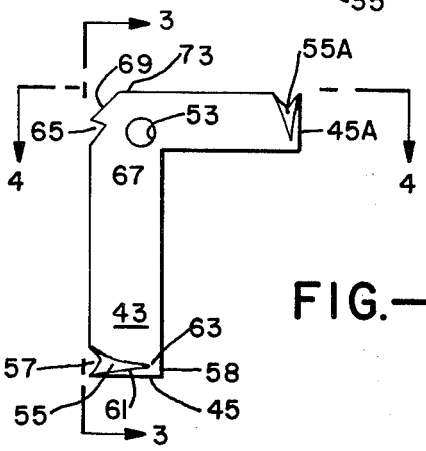
FIG. 2 is a front elevation of the key device of the present invention.
Figure 3:
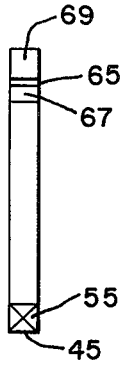
FIG. 3 is a side elevation of the present invention taken along lines 3—3 of FIG. 2.
Figure 4:
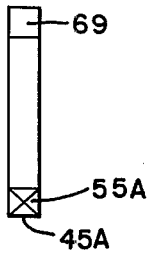
FIG. 4 is an end elevation of the present invention taken along lines 4—4 of FIG. 2.

Applicant's invention, as shown in FIGS. 2, 3, and 4, provides a tool for releasing and replacing locking member 37 on sprocket shafts 29 and 30 using a simple twisting motion. The invention is a key comprised of a rigid body 41 which has an enlarged portion 43 terminating in a flat edge 45 of suitable size for fitting within the central opening 39 of locking member 37. In its preferred form, the elongated end has a rectangular cross-section having a width slightly smaller, and a length slightly greater than the width of the central opening of the locking member. This geometry allows the elongated end to fit lengthwise within the central opening and be rotated until opposite edges 47 and 49 of the key engage the interior edges 51 of the elongated sides of the locking member.

The rigid body is preferably L-shaped as shown in FIG. 2, and may have a hole, such as 53, formed therethrough such that the key of the present invention can be conveniently carried on a key chain.

Release groove 55 is formed on the elongated rod 43 of rigid body 41 adjacent to and parallel flat end 45. In the preferred embodiment, a release groove 55, 55A is formed at the end of each leg of the L-shaped body. In most situations either of these release grooves can be used to remove the locking member, however, in some situations it might be convenient to use the slightly longer reach provided by the longer leg of the L-shaped body, whereas in other situations where slightly greater leverage may be required, the longer leg of the L-shaped can be used for gripping since this longer portion of the body can be more easily held.

Release groove 55 has an open end 57 on the outside edge 59 of the rigid body 41, and tapers therefrom along its length to form a wedge 61 with flat end 45. As release groove 55 tapers away from outside edge 59, the depth of the groove decreases such that the groove terminates by blending into the side of the rigid body at 63. It is noted that the release groove, in the preferred form of the invention, runs along both sides of the rigid body from open end portion 57.

Figure 5:
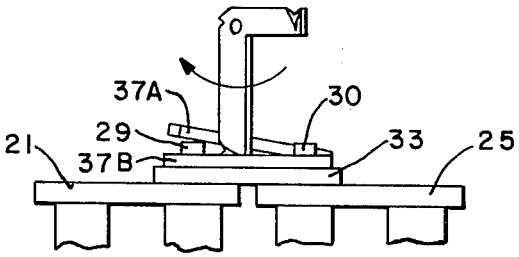
FIG. 5 is a side elevation of two adjacent drive chain links showing the key device of the present invention positioned for releasing the locking member from its locked position on the drive chain. Rotation in a counter-clockwise direction is indicated as the first step of releasing the locking member.
Figure 6:
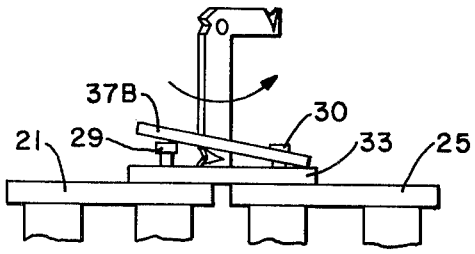
FIG. 6 shows the drive chain and key device of FIG. 5 with the key device being rotated in a counter-clockwise direction as the second and final step of releasing the locking member from the drive chain.

To release locking member 37 from sprockets 29 and 30, flat end portion 45, or, alternatively, flat end portion 45A on the shorter leg of the L-shaped body, is placed against joining plate 33 within the central opening 39 of locking member 37 with the open end 57 of release groove 55 pointing toward the split end 39 of the locking member as is shown in FIGS. 5 and 6. As the key device is firmly held against joining plate 33, it is rotated as is shown in FIG. 5 until the front portion of the release groove at the tip of wedge 61 engages the interior side of leg 37A of the locking member. At this point, the base 58 of the release groove, that is the side of the body opposite the release groove, should be engaged with the internal edge of the locking member's opposite leg 37B. With continued twisting of the key device, the tip of wedge 61 is forced between locking member leg 37A and underlying joining plate 33, and with further rotation thereof, leg 37A is forced upward and outward as it rides up the ramped portion of the wedge until the end of the locking member leg proximate the split portion 39 rides up over the enlarged portion of sprocket shaft 29. The key device is now rotated in the opposite direction as is shown in FIG. 6 for releasing of the opposite leg from the sprocket in the same manner as the first leg.

Once the split end of the locking member is entirely removed from sprocket shaft 29, the locking member can be removed from sprocket shaft 30 by first rotating and sliding the locking member to position the split end 39 at sprocket shaft 30, and by then grabbing the loose end of the locking member and simultaneously working it back and forth and in an upward direction.

In its preferred form, the present invention also includes reset groove 65 formed in the body of the key such that the key device can be used to replace a detached locking member into locking engagement with the drive chain sprocket shafts. The reset groove is a transverse groove formed in the edge and situated proximate the elbow of the L-shaped body of the key. One side of this groove, shown as reset surface 67, is for engaging in top of the locking member; it is generally flat, and is angled with respect to outside edge 59 of the body. Flat pivotal surface 69 is formed adjacent reset groove 65, and is angled from its intersection with the reset groove approximately parallel to the reset groove's reset surface 67.

Figure 7:
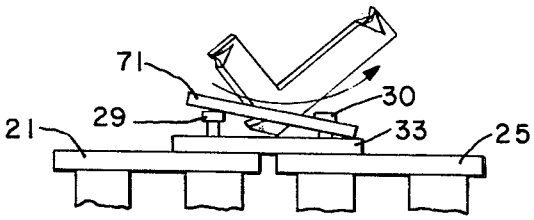
FIG. 7 shows the drive chain and key device of FIG. 5 with the key device positioned for resetting the locking member to locking engagement with the drive chain sprocket shafts. Rotation is indicated in the counter-clockwise direction as the first step in resetting the locking member.
Figure 8:
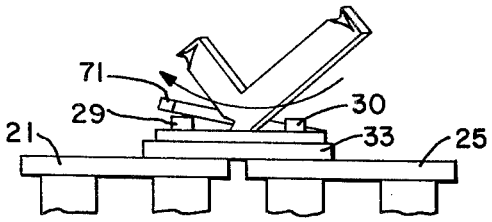
FIG. 8 shows the drive chain and key device of FIG. 7 with the key device being indicated as being rotated in a clockwise direction as the second and final step of resetting the locking member.

FIGS. 7 and 8 show how the key device of the present invention is used to replace locking member 71 onto sprocket shaft 29 and 30. Sprocket shaft 30 is first placed through one end of the central opening of the locking member. This is done by placing the central opening of the locking member over the enlarged portion of sprocket shaft 30, and, by holding the loose end of the locking member, exerting a firm downward pressure until the locking member snaps over the enlarged portion of the sprocket shaft. The locking member should now be arranged such that the end of the central opening adjacent the split end of the locking member is loosely positioned over the enlarged portion of sprocket shaft 29. As is shown in FIG. 7, the flat pivotal surface of the key device is then placed against underlying joining plate 33 with the reset groove 67 overlying one leg of the locking member. Care should be taken that the reset groove is pointing toward the split end of the locking member which has been placed above sprocket shaft 29. Holding the key firmly against the joining plate surface, the key is rotated, such as in the counter-clockwise direction shown in FIG. 7, until the outer edge portion 73 of the body situated on the opposite end of the pivotal surface from the reset groove engages the interior edge of the locking member which is opposite the leg of the locking member engaged by the reset groove. At this point, opposite sides of the key at opposite ends of the pivotal surface should be engaged with opposite interior edges of the locking member. With continued rotation, the leg of the locking member engaged by the reset groove is forced outward and downward by reset surface 69 until it snaps over the enlarged portion of sprocket shaft 29. In a similar manner the remaining disengaged leg of the locking member is forced to locking engagement with sprocket shaft by rotating the key in the opposite, or clockwise, direction as is shown in FIG. 8.

The present invention provides a new and novel key device which can easily, quickly, and safely remove a locking member from its locking engagement with the sprocket shafts of adjacent links of a drive chain. The present invention, in addition, can be used to replace a detached locking member to its locked position. The invention greatly improves on the old method prying at locking members with a screwdriver, and has the advantage of providing a small tool which is easily and cheaply manufactured and can conveniently be carried in a person's pocket.

Although the present invention has been described in considerable detail in the preceding specification, it should not be limited to such a description except as may be necessitated by the appended claims.

I claim:

1. A key for removing locking members from drive chains or the like comprising a rigid body having an elongated portion with a flat end of a size to fit within the central opening of the drive chain locking member, at least one release groove formed in said body adjacent to and parallel the flat end of said elongated portion, said groove being tapered so as to form a wedge with said flat end whereby, when the flat end of said elongated portion of said body is placed within the central opening of said locking member and said flat end is held against the chain link underlying said locking member, the key can be rotated to permit both the release groove to engage one internal edge of the locking member within the central opening, and the side of the body opposite the release groove to engage the opposite internal edge of the central opening whereby the wedge formed by said release groove causes the side of the locking member engaged by the release groove to separate and lift from its locked position when the key is further rotated, and a reset groove formed in said body such that when said locking member is loosely positioned over suitably spaced locking member sprocket shafts said reset groove can engage one of the internal edges of said locking member within its central opening permitting the key to force said locking member into locking engagement with said sprocket shafts by rotating said key within said central opening while the key is held firmly in contact with the surface of the underlying chain link.

2. A key for removing locking members from drive chains or the like comprising a generally L-shaped rigid body having a substantially rectangular cross-section and legs having substantially flat end of a size to fit within the central opening of the drive chain locking member, a release groove formed adjacent to and parallel the flat end of at least one leg of said L-shaped body, said release groove being tapered so as to form a wedge with said flat end whereby, when the flat end of said elongated portion of said body is placed within the central opening of said locking member and said flat end is held against the chain link underlying said locking member, the key can be rotated to permit both the release groove to engage one internal edge of the locking member within the central opening, and the side of the body opposite the release groove to engage the opposite internal edge of the central opening whereby the wedge formed by said release groove causes the side of the locking member engaged by the release groove to separate and lift from its locked position when the key is further rotated, and a reset groove transversely formed on the outer edge of said L-shaped body proximate the elbow thereof whereby said reset groove can engage a locking member loosely positioned over suitably spaced locking member sprocket shafts permitting the key to force said locking member into locking engagement with said sprocket shafts by rotating said key while the key is held in contact with the underlying chain link surface.

3. The key of claim 1 wherein a generally flat pivotal surface is formed on said key adjacent said reset groove, said flat pivotal surface being angled from its intersection with said reset groove approximately parallel to the locking member reset surface formed by the internal surface of said reset groove opposite the intersection of said pivotal surface and reset groove whereby, when said pivotal surface is held against the chain link underlying said locking member within the central opening thereof, said key can be rotated on said first flat pivotal surface such that, while opposite sides of the key at opposite ends of the pivotal surface engages opposite internal edges of said locking member within the central opening, the reset surface of said reset groove engages the top of one side of said locking member urging that side of the locking member slightly outward and downward into locking engagement with said sprocket shafts, and whereby, when the key is rotated in the opposite direction the remaining unengaged side of said locking member can in the same manner be urged into locking engagement with said sprocket shafts.

4. A key for removing locking members from drive chains or the like comprising a generally L-shaped rigid body having a substantially rectangular cross-section and legs having substantially flat ends of a size to fit within the central opening of the drive chain locking member.

a release groove formed in at least one leg of said L-shaped body adjacent and substantially parallel the flat end of said leg, said groove extending from one edge and along both sides of said leg and tapering in a generally V-shape such that the bottom of said groove forms a wedge with the flat end of said leg of said key whereby, when the end of the leg of said L-shaped body having said release groove is placed within the central opening of said locking member and is held against the underlying chain link, the key can be rotated to permit both the release groove to engage one internal edge of the locking member within the central opening, and the side of the body opposite the release groove to engage the opposite internal edge, so that with further rotation the wedge formed by the tapering of said release groove causes the locking member to be forced outward and upward from its locked position, a reset groove transversely formed in the outer edge of said L-shaped body proximate the elbow thereof, and a generally flat pivotal surface extending at an angle from one side of said reset groove to the outer edge of the opposite leg of said L-shaped body and approximately parallel to the reset surface formed by the portion of the reset groove surface opposite the intersection of said pivotal surface with said reset groove whereby, when said locking member is loosely positioned over suitably spaced locking member sprocket shafts and said flat pivotal surface is held against the surface of the underlying drive chain within the central opening of said locking member, said L-shaped body can be rotated such that while opposite sides of the key at opposite ends of the pivotal surface engage opposite internal edges of the locking member within its central opening, the reset surface of said reset groove engages the top of one side of the locking member urging that side of the locking member slightly outward and downward into locking engagement with said sprocket shafts, and, whereby, when the key is rotated in the opposite direction the remaining unengaged side of said locking member can in the same manner be urged into locking engagement with said sprocket shafts.

* * * * *